US006729097B2

(12) United States Patent
Patel et al.

(10) Patent No.: US 6,729,097 B2
(45) Date of Patent: May 4, 2004

(54) HOLLOW BUILDING PANEL HAVING AN ANGLED SUPPORT MEMBER AND METHOD OF MAKING SAME

(75) Inventors: Kartik A. Patel, Landisville, PA (US); Darryl C. Bodine, Lancaster, PA (US)

(73) Assignee: Armstrong World Industries, Inc., Lancaster, PA (US)

( * ) Notice: Subject to any disclaimer, the term of this patent is extended or adjusted under 35 U.S.C. 154(b) by 0 days.

(21) Appl. No.: 09/872,517

(22) Filed: Jun. 2, 2001

(65) Prior Publication Data

US 2002/0043035 A1 Apr. 18, 2002

Related U.S. Application Data

(60) Provisional application No. 60/239,656, filed on Oct. 12, 2000.

(51) Int. Cl.[7] ..... E04C 2/42; E04C 5/04; E04F 15/06; E04F 19/10

(52) U.S. Cl. ..... 52/665; 52/650.3; 52/762; 52/489.1

(58) Field of Search ..... 52/177, 483.1, 52/489.1, 762, 506.01, 506.06, 182, 181, 188, 191, 403.1, 480, 650.3, 665, 522, 527, 537, 539

(56) References Cited

U.S. PATENT DOCUMENTS

| | | | | | |
|---|---|---|---|---|---|
| 5,009,045 | A | * | 4/1991 | Yoder | 52/177 |
| 5,033,147 | A | * | 7/1991 | Svensson | 14/73 |
| 5,337,535 | A | | 8/1994 | Maupin | 52/748 |
| 5,613,339 | A | * | 3/1997 | Pollock | 114/263 |
| 5,625,985 | A | | 5/1997 | Johnson | 52/177 |
| 5,642,592 | A | * | 7/1997 | Andres | 114/266 |
| 5,647,184 | A | * | 7/1997 | Davis | 52/592.1 |
| 5,651,154 | A | * | 7/1997 | Ahlskog et al. | 14/6 |
| 5,758,456 | A | | 6/1998 | Case | 52/177 |
| 5,758,467 | A | * | 6/1998 | Snear et al. | 52/177 |
| 5,819,491 | A | * | 10/1998 | Davis | 52/100 |
| 5,836,128 | A | * | 11/1998 | Groh et al. | 52/580 |
| 5,950,377 | A | * | 9/1999 | Yoder | 52/177 |
| 6,044,598 | A | * | 4/2000 | Elsasser et al. | 52/177 |
| 6,079,175 | A | * | 6/2000 | Clear | 52/404.1 |
| 6,112,479 | A | * | 9/2000 | Andres | 52/177 |
| 6,170,212 | B1 | * | 1/2001 | Suchyna et al. | 52/177 |
| 6,272,808 | B1 | * | 8/2001 | Groh et al. | 52/314 |
| 6,276,634 | B1 | * | 8/2001 | Bodle | 244/188.5 |
| D451,612 | S | * | 12/2001 | Thibault | D25/119 |
| 6,324,796 | B1 | * | 12/2001 | Heath | 52/177 |

FOREIGN PATENT DOCUMENTS

| | | | | |
|---|---|---|---|---|
| JP | 6--146622 | * | 5/1994 | E04H/1/12 |
| JP | 6-173333 | * | 6/1994 | E04B/1/00 |

* cited by examiner

*Primary Examiner*—Carl D. Friedman
*Assistant Examiner*—Chi Q Nguyen

(57) ABSTRACT

A hollow building panel is provided having a first member, a second member spaced apart from the first member, and at least one support member disposed between and interconnecting the first and second member. At least one groove is formed in the first member exposed surface and the support member is attached to the first member at a vertex formed by the groove. The panel includes a locking assembly whereby two adjacent panels may be joined together.

28 Claims, 3 Drawing Sheets

HOLLOW BUILDING PANEL HAVING AN ANGLED SUPPORT MEMBER AND METHOD OF MAKING SAME

This application claims the benefit under 35 U.S.C. §119(e) to U.S. provisional patent application No. 60/239,656, filed Oct. 12, 2000, and the entire content of that patent application, including the claims and drawings, is hereby incorporated as if fully set forth herein.

BACKGROUND

I. Field of the Invention

The present invention generally relates to building panels and methods of making building panels. More specifically, the present invention relates to hollow building panels having internal supporting structures and locking assemblies formed therein.

II. Background of the Invention

The use of interlocking wooden planks or panels to fashion ceilings, walls, wainscoting and flooring is well known in the building industry. Tongue-and-groove wooden paneling systems are widely used in all types of living spaces, such as porches, sunrooms, decks and kitchens. A typical wooden tongue-and-groove wood panel system, as shown in FIG. 1, includes panels having projecting tabs or "tongues," which are received by corresponding "grooves" on adjacent panels. The interlocking of a tongue of one panel with the groove of an adjacent panel provides the means by which an entire panel system may be joined and installed. Once joined, the planks may exhibit a V-shaped groove at the junction of the panels.

As indicated, typical wood paneling systems are composed of individual panels, wherein each individual panel is visible in the installed finished product. It is desirable to provide a paneling system having larger panels that, when installed, appear as smaller wooden panels. Providing larger panels would thereby reduce the number of panels required to be installed in a given space, as well as the time and cost of installation. In typical wood paneling systems, the visual width of the panel is the same as the physical width of the panel. For instance, if a ceiling or wall paneling is desired that has grooves at 2-inch intervals, the planks or panels used will be 2 inches wide. The narrower the plank is, the more planks required to cover a given width of wall or ceiling. The use of narrow planks tends to increase the installation cost of covering a given area. Therefore, a way is needed to reduce the installation costs by utilizing fewer discrete panels, while still realizing a visual effect that suggests narrow planks.

Wood products dominate the paneling market, since consumers tend to favor the aesthetic qualities of wood over current alternatives. However, synthetic alternatives to wood typically provide other advantages, such as moisture resistance, reduced weight, enhanced fire resistance and lower cost. Nevertheless, synthetic polymeric paneling products must meet consumer's aesthetic expectations in order to compete with wood. Thus, there is a need to provide a synthetic polymer panel with a high quality fit and finish comparable to wood.

With the increase in building of outdoor living spaces comes a need to provide paneling suitable for withstanding the accompanying climate conditions. Ranges of temperature, humidity and light tend to be broader outdoors than indoors. There exists a need for ceiling, flooring and wall materials that target such demanding environments. Currently, most commercially available ceiling products are not intended for outdoor or high-humidity applications. Although, increases in the construction of outdoor living spaces such as sunrooms, porches and decks, are evident.

Such demanding environments require that consideration in designing and installing a paneling system take into account the impact of varying temperature and humidity on the choice of construction materials. In a given installation, panels will expand and contract significantly along their length as the ambient temperature varies. If the panels are simply nailed to a surface, then warping or sagging can develop. Thus, a system is needed that will provide for thermal expansion and contraction of the panels.

Although plastic panels are known to be less susceptible to these environmental conditions, known means of fastening such panels to the surface of a building are not much advanced over those known for typical wooden systems. In fact, plastic panels are typically attached by nailing or stapling. Typically, a flange is provided along an edge of the panel for the purpose of attaching the panel to a surface. Unfortunately, when attaching the panels, for instance, with a nail, the head of the nail must be hidden and sufficiently fastened such that the height of the nail head does not hinder attachment of the next panel to be installed. Thus, there is a need for a feature that hides the attachment member and provides sufficient clearance to prevent the appearance of bumps in the surface of the panel.

Replacing a typical wooden paneling system with, for instance, a solid plastic panel may prove to be expensive and difficult. The use of significantly more material could significantly increase the weight and material costs of the product, and could also create challenges in manufacturing, such as attempting to provide uniform cooling of the material to prevent warping. Conversely, providing hollow panel replacements raises another set of challenges including, but not limited to, avoiding potential warping and/or buckling, overcoming manufacturing difficulties, and providing sufficient strength and rigidity in a panel. A panel should exhibit the strength and rigidity necessary for handling, installation, and crush resistance. Also, a panel should display a smooth and consistent finish in order to meet consumer expectations. Typically, hollow panels with reinforcing ribs tend to show evidence on the panel surface of the presence of these ribs. Such evidence is usually considered a surface defect and tends to be objected to by the consumer.

Thus, there remains a need for a hollow panel that is easy to make, and that provides strength, rigidity, and an aesthetically pleasing appearance.

SUMMARY OF THE INVENTION

The present invention is directed, in part, to a hollow panel having at least one support member connecting a base member of the panel to a face member thereof. The face member is spaced apart from the base member and includes at least one groove formed therein. The support member is attached to the face member adjacent the groove, so that no seam or other surface defect, arising from the attachment of the support member to the face member, is visible on the exposed surface of the face member. The support member(s) may be angled relative to the face member in order to provide efficient and effective support for the face member.

The present invention also encompasses, in part, panels including locking assemblies formed therein. A panel may have both a first flange extending along a first edge of a base member and a second flange, spaced apart from the first flange, also extending along the first edge of the base member. The panel also may include at least one spring tab extending from a second edge of the base member. Adjacent to this second edge is a recessed portion formed in the base member. With these aspects of the locking assembly included in the base members of a paneling system, one panel may be installed and a second panel installed adjacent the first panel, with a first edge of the first panel abutting the second edge of the second panel. The first panel may be installed by fastening the first flange to the mounting surface. The second panel may then be locked to the first panel by engaging the spring tab(s) of the second panel with the second flange of the first panel. Consequently, the present invention also is directed, in part, to installing interlocking panels. The resulting interlocking panel system may have grooves, or similar formations, formed by the cooperation of a shoulder of one panel and a shoulder of an adjoining panel, wherein these formations are similar to those formed in the face member of the panel.

These and other aspects of the present invention are set forth in the brief description of the drawings and the detailed description of the invention set forth below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures wherein.

DETAILED DESCRIPTION OF THE INVENTION

Figure 1:
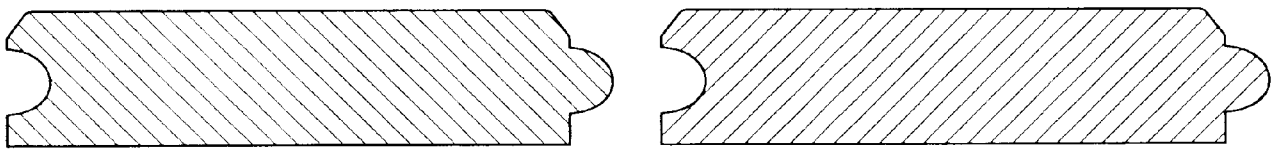
(PRIOR ART) Fig. 1
FIG. 1 is an end view of a typical tongue and groove planking system according to the prior art.

Reference will now be made in detail to some of the embodiments of the invention, one or more examples of which are illustrated in the drawings. Each example is provided by way of explanation of the invention, and is not meant as a limitation of the invention. For example, features illustrated or described as part of one embodiment can be used on or in conjunction with other embodiments to yield yet a further embodiment. It is intended that the present invention includes such modifications and variations.

Figure 2:
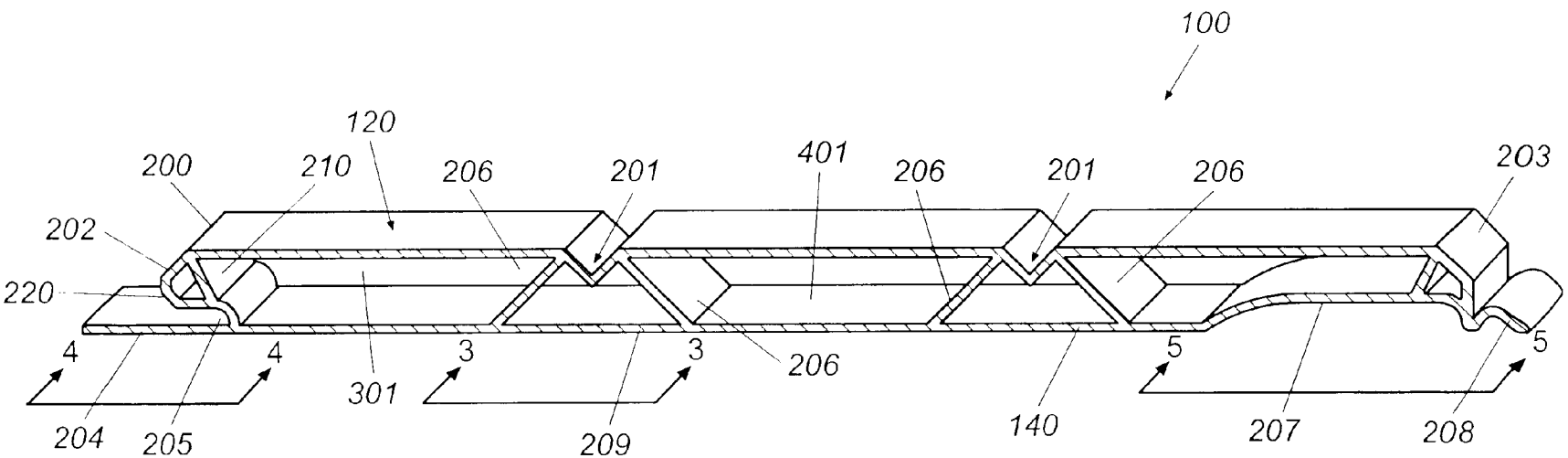
FIG. 2 is a perspective view of a section building panel according to one embodiment of the present invention.

A perspective view of a section of an exemplary building panel 100 according to the present invention is shown in FIG. 2. As shown, the length of the building panel 100 may be markedly longer than its width. For example, a typical building panel 100 may have a length in the range of about 2.4 m to about 3.7 m (or about 8 feet to 12 feet) and a width of about 17 cm (or about 6.5 in.). However, it is contemplated by the present invention that the building panel have a wide range of lengths and widths and ratios therebetween.

The building panel 100 of the present invention is typically an extruded plastic panel system having angled support members. The building panels according to this invention are further provided with a fastening mechanism that allows for thermal expansion. When properly installed, the fastening mechanism accommodates for thermally induced dimensional changes in the building panel. This reduces the chances for buckling or warping of the building panel when exposed to a broad range of temperatures.

Figure 3:
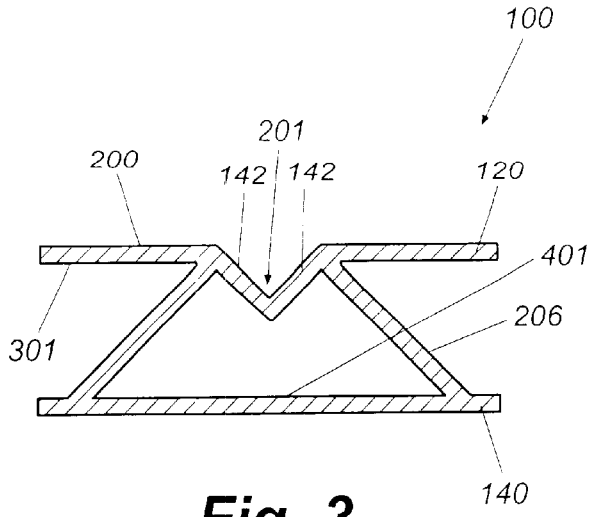
FIG. 3 is a cross-sectional side view of a portion of the building panel section taken along lines 3—3.

As shown in FIG. 3, the building panel 100 of the present invention includes a first or face member 120, at least a portion of which is spaced apart from a second or base member 140. At least one support member 206 is disposed between and interconnecting the face and base members 120 and 140. The support member(s) 206 may be disposed at an angle between the first member 120 and second member 140, thereby providing structural support and rigidity to the building panel 100. As used herein, to state that the support members 206 are disposed at an angle, means that the support member 206 forms an angle other than 90° with at least a portion of both the first member 120 and second member 140. The angle of disposition of the support member 206 relative to face and base members 120 and 140 may vary, although one embodiment of the building panel 100, shown in FIG. 3, includes an angle of disposition of the support member 206 of about 45°. An angle of about 45° has been shown to provide excellent strength. One embodiment of the present invention includes at least one first support member 206 attached to the first member at a first vertex, wherein the support member 206 is angled at a first angle relative to a primary elevation of the first member 120 and a second support member attached to the first member at a second vertex. The second support member is angled at a second angle relative to the primary elevation, wherein the first angle is equal and opposite to the second angle.

As shown in FIG. 2, face member 120 may have an exposed or face surface 200 and a concealed or inner surface 301. The exposed surface 200 may be flat and may be finished with a wood or similar design. When the building panel 100 is installed, face surface 200 is the portion of the panel 100 which is visible. Exposed surface 200 faces away from the supporting surface or substrate 709 to which the building panel 100 is attached. Second member 140 also may have an inner surface 401 and a backing surface 209. Each of the first member 120 and second member 140 may have thicknesses ranging between about 0.02 inches and about 0.05 inches. A typical thickness for each may be about 0.022 inches. Face surface 200 may be smooth, textured, striated, colored, or otherwise modified, so as to be attractive to a consumer. Also contemplated herein, face surface 200 may contain a low-light reflectance pattern.

One embodiment of the building panel 100, as shown in FIG. 2, includes at least one groove or longitudinal depression 201 formed in the face surface 200 of first member 120, thereby providing the appearance of multiple narrower panels joined together. The longitudinal depression formed in the first member may have a first sloped wall and a second sloped wall, wherein these walls form at least one vertex within the first member. A building panel 100, 10 cm wide, may have a groove disposed down the center of face surface 200, resulting in the appearance of two 5 cm wide interlocked panels. In order for the visual affect of the groove to be convincing, the groove can be nearly identical to the joints between adjacent building panels 100. Typically, the grove will be shaped in the form of a V-groove or other decorative joint.

A sectional view of the groove element 201 is shown in FIG. 3. Such grooves 201, useful in the present invention, can have a variety of profiles. Each groove 201 approximates the look of a joint between similar, adjacent panels. Although the ranges can vary markedly within the present invention, typical spacing between grooves 201 is about 5 cm (or 2 in), and the distance from each groove to the nearest outside edge is likewise about 5 cm (or 2 in). The walls 142 of each groove 201 are typically disposed at about a 45° angle relative to the flat portion of face surface 200. Each groove 201 is nominally about 0.63 cm (or about 0.25 in) wide. In one embodiment of the present invention, support members 206 are attached to first or face member 120 at or adjacent to at least one side of groove 201 or at one or more vertices formed in first or face member 120. This positioning of the support member of 206 minimizes visible variations in face surface 200, which would normally be apparent at the point of attachment. In fact, positioning the support members 206 in the vertices of the grooves 201 tends to completely hide their presence from view. The result of this position of the support members 206 is a building panel having a high-quality look with a smooth surface absent surface deformations found in other panel systems.

Figure 8:
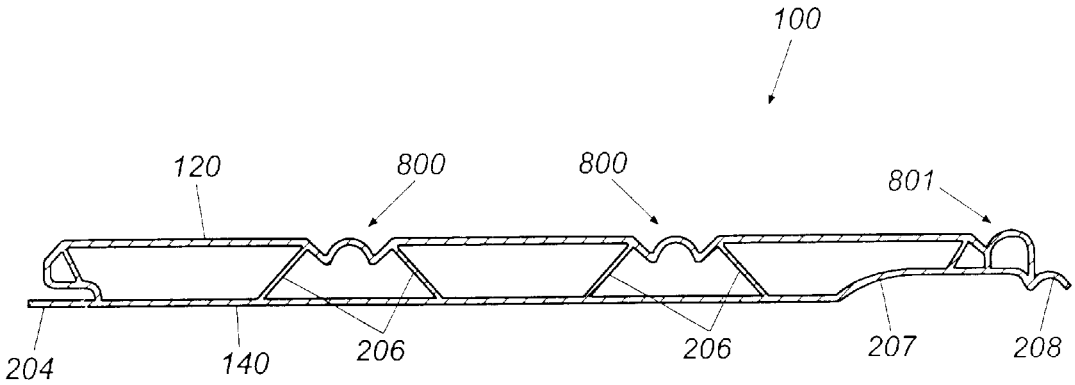
FIG. 8 is a side view of another embodiment of a building panel according to the present invention, illustrating decorative semicircular protrusions extending from grooves in the panel.

The present invention may be realized with a variety of groove profiles including, but not limited to, those disclosed herein. One alternative embodiment presents the appearance of a beaded groove 801, shown in FIG. 8, which is another common style of tongue-and-groove planking. Beaded groove 801 includes a semicircular protrusion 800 that extends from the groove 801. Another alternative embodiment may include a double bead or other decorative element in the grooves. Other decorative or utility elements may be formed in the first member so as to result in the first member having a primary elevation across the face surface thereof and a secondary elevation corresponding to such elements.

Figure 6:
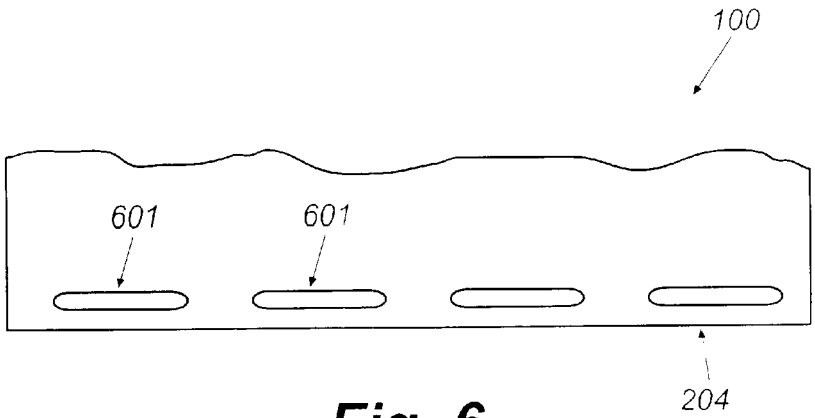
FIG. 6 is a top view of a fastening flange useful with a building panel according to the present invention.
Figure 7:
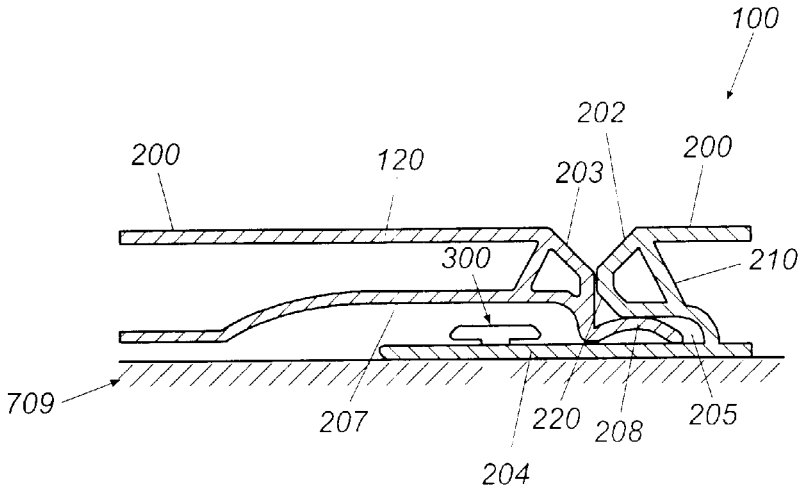
FIG. 7 is a sectional side view of two building panels according to the present invention showing fastening of one panel to a supporting surface and the mating engagement of the other building panel to the thus fastened panel.

Turning to FIG. 6, a fastening flange 204 extends from one edge of the building panel 100 for the purpose of providing a mechanism for attaching the building panel to a supporting surface or substrate (not shown). Fastening flange 204 may include at least one slot 601 along its length and, optionally, a series of slots 601. As shown in FIG. 7, slot 601 provides a point of attachment for a fastener 300. Fastener 300 may be any well known device, such as a nail, screw, staple and the like. Slots 601 may be nominally about 2.47 cm (or about 0.975 in) long and about 0.64 cm (or about 0.125 in) wide, on an about 1.75 in center, although variations to these figures are certainly contemplated by the present invention. The fastening flange 204 typically may have the following dimensions: nominally about 0.026 in thick, while extending from the building panel a width of about 0.53 in.

During installation of the building panel system, thermal expansion may be accommodated by securing the fastener(s) 300 at the center of each slot 601. Further, the fastener typically is fastened in such a way that allows the building panel to expand and contract. Therefore, if fastener 300 is used properly, slots 601 allow for relative movement between the building panel 100 and the fastener as both the building panel and the substrate change due to thermal expansion.

Figure 4:
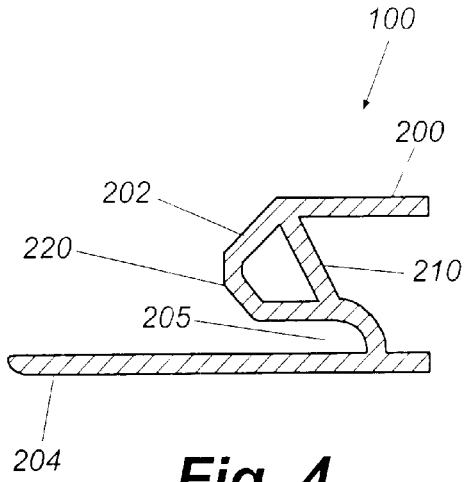
FIG. 4 is a sectional side view of the section of the building panel of FIG. 2 taken along lines 4—4.
Figure 5:
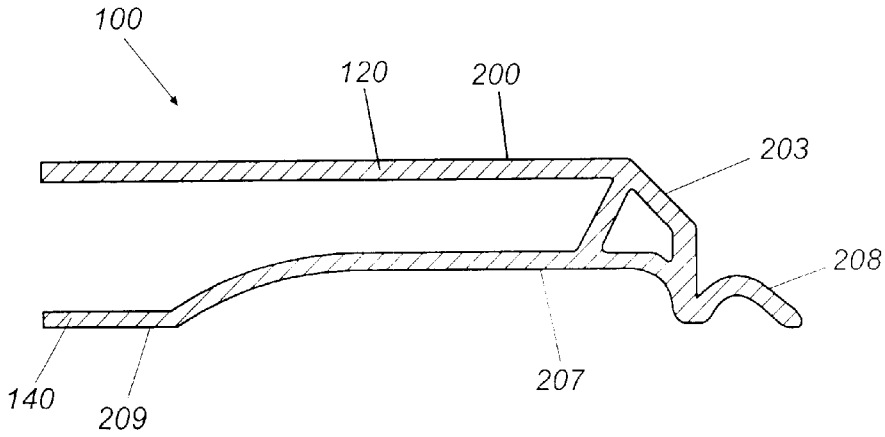
FIG. 5 is a sectional side view of the section of the building panel of FIG. 2 taken along lines 5—5.

Two sides of face surface 200 are bounded with shoulders or angled elements 202 and 203, as shown in FIGS. 2, 4 and 5. These shoulders 202 and 203 typically have the same contours or angles as the first and second walls 142 of the groove or longitudinal depression 201. The joining of first and second shoulders 202 and 203 on adjacent panels forms a peripheral longitudinal depression, such as a peripheral groove, that may be dimensionally equivalent to or at least visually similar to the longitudinal depression, or groove, formed within the first members of those panels. As shown in FIG. 4, a rib 210 provides additional support to the structure of the building panel 100 along the edge thereof adjacent the first or fastening flange 204. This rib 210 is joined at the upper end to the edge vertex 402 formed by the angled element 202 and the first member 120, and at the lower end to the upper surface of the tab-receiving cavity 205. Tab-receiving cavity 205 is bounded, in part, by first flange 204 and second flange 220. The rib 210 strengthens and supports both the interlocking attachment of adjacent building panels and the groove formed thereby. Upon the interlocking attachment of two panels, the angled element 202 on one panel cooperates with the angled element 203 on the other panel to form a groove 405, which is visually similar to groove 201, or similar decorative element, as shown in FIG. 7.

As shown in FIGS. 2 and 7, the present invention includes a locking assembly by which adjacent panels may be attached to each other, while allowing for longitudinal expansion due to thermal effects. The locking assembly includes a first flange 204 extending from a first edge of the base member of one panel and a second flange 220, spaced apart from the first flange 204 and also extending from the base member. The locking assembly also includes an interconnect tab extending from a second edge of the base member of an adjacent panel. The tab may be a spring tab 208, as shown in FIG. 7. Additionally, a recessed portion 207, which may provide clearance for common nail heads or other fasteners, may be formed in the base member of the adjacent panel, adjacent the second edge of the panel. As shown in FIG. 2, each panel may include all the elements of the locking assembly of the present invention disposed along the edges thereof. A tab receiving cavity 205, (see FIGS. 2 and 4), is formed, which may be about 0.2775 in long and about 0.08 in high. The tab receiving cavity 205 receives the spring tab 208 from an adjacent building panel 100 and serves to retain the adjacent panel during installation. The spring tab 208 is typically curved and has some elasticity. The tab 208 is received within the tab-receiving cavity 205 when the panels are installed. The tab 208 flattens as it engages the adjacent panel's tab receiving cavity 205 to provide a retentive force that holds the adjacent panel in position to facilitate fastening. In the installed position and as shown in FIG. 7, the angled elements 202 and 203 have joined to form a V-groove that is visually similar to the groove(s) 201 elsewhere in the building panel. The fastening flange 204 is shown with a fastener 300 projecting into the space created by the cavity 207 and penetrating the supporting surface 709 on which the building panels are installed.

As shown in FIG. 7, the locking assembly may be utilized by engaging the spring tab 208 of one panel with the first and second flanges 204 and 220 of the adjacent panel. First flange 204 may then be disposed adjacent to recessed portion 207 and second flange 220 may abut a portion of the other panel. In this manner, adjacent panels may be interlocked.

The building panel of the present invention provides an installation process which is simpler than currently known methods. More particularly, during installation, the locking assembly attaches a first building panel to a second panel, which is already secured to the substrate by one or more fasteners, thereby retaining the first panel in position as fasteners are attached thereto. The building panels according to the present invention have a lower installation cost than current wood paneling systems, due to the fewer number of panels necessary to cover a given area. Consequently, when comparing current wood panel systems, which are typically sold in 2 to 4-in widths, with building panels of the present invention, which may be 6 in wide, an installer can cover at least about 50% more surface area with each panel of the present invention installed. This dimensional variation can significantly reduce installation costs, as well as manufacturing costs, on a per-square-foot basis.

The locking assembly of the present invention holds adjacent building panels together during installation. There are many well known methods for interlocking adjacent panels. Traditionally, a double-walled interlock tab, or tongue, has been utilized to engage or connect adjacent planks. The interlocking system embodied in the present invention's single-walled tongue requires less material and space than necessary for prior systems, while sill adequately retaining the building panel in position during installation.

The building panel according to the present invention is typically made of any of, but not limited to, the following materials: polymers, copolymers, homopolymers and/or combinations thereof, wood, and metal. Typically, exemplary polymers useful in the present invention include: polyvinyl chloride (PVC), polycarbonate, polyacetal, polyamide, and polyethylene. PVC is highly resistant to humidity and has a high temperature coefficient of expansion. Historically, consumers have rejected plastic ceiling planking because of surface irregularities and poor finish quality. The present invention provides a high-quality building panel product that overcomes the aesthetic deficiencies that have traditionally kept plastic planking products from being widely accepted in this market. The building panel of the present invention has the added advantage of good fire resistance and good fire performance due to the selection of resins used to form the panel.

The method for making the building panel includes extruding a polymer to form the building panel. Typically, the building panel, if formed from a polymer, will be integrally molded. One such method for forming the building panel of the present invention includes utilizing profile extrusion. Profile extrusion is a process that continuously forms a particular shape by forcing a polymeric material through a calculated opening in a die. The process begins with the dried plastic being conveyed to the extruder which feeds, mixes and heats the material to the desired viscosity and forces the melted polymer through a die with an opening calculated to supply the molten polymer to a sizing device which solidifies and then cools the product to accurate dimensions. The extrudate is pulled at a constant rate to insure uniform cooling and sizing by a puller.

Sizing and cooling fix the dimensions of the building panel. The part goes through a vacuum sizing tank which lowers the air pressure outside the part so the greater pressure inside pushes the surface out against precision sizing tools. The desired length is then cut with a traveling saw.

When forming the building panel according to the present invention through, for instance, an extrusion or injection molding process, at least one die line (not shown) will typically be disposed within the groove of the first member exposed surface. In other words, at least one groove can be formed coincident with a die line in such a way that the die line is substantially hidden within the groove.

As further contemplated herein, the building panel of the present invention may be formed using other methods. For instance, each of the components including the first and second members, as well as the support members, could be cut from a sheet of plastic, or even wood. The groove(s) could then be cut into the first member exposed surface. Then, using an attachment device, such as welding, glue, nails, and the like, the components could be assembled into the building panel. Additionally, it is possible to form the building panels of the present invention using injection-molding processes as would be understood by those having skill in the art.

Having thus described the invention in detail, it should be apparent that various modifications can be made in the present invention without departing from the spirit and scope of the following claims.

What is claimed is:

1. A panel having a base member and a locking assembly; the locking assembly comprising a first flange extending from a first edge of the base member, a second flange projecting from the first edge of the base member, the second flange being spaced above the first flange, a recessed portion formed in the base member adjacent a second edge of the base member; the recessed portion being interposed between the first and second edges, and a tab extending from the second edge of the base member.

2. The panel of claim 1, wherein the first flange of the locking assembly includes at least one longitudinal slot formed therein.

3. The panel of claim 1, wherein the tab of the locking assembly is a spring tab.

4. The panel of claim 1, wherein the locking assembly further comprises a fastener cooperating with the first flange.

5. The panel of claim 1, further including a face member spaced above the base member and connected to the base member by a support member.

6. The panel of claim 5, wherein the support member is attached to the face member adjacent a vertex formed therein.

7. A hollow building panel comprising:

a face member having a flat finished surface and at least one groove formed therein, a first angled support member attached to the face member at a first vertex formed in the face member adjacent the groove and a second angled support member attached to the face member at a second vertex formed adjacent the groove, wherein the first angled support member is angled at a first angle relative to the flat finished surface of the face member and the second angled support member is angled at a second angle relative to the flat finished surface of the face member, the first angle being equal and opposite to the second angle;

a first angled shoulder depending from a first edge of the face member; and, a second angled shoulder depending from a second edge of the face member.

8. The hollow panel of claim 7, further comprising a base member connected to the face member by the first and second angled support members.

9. The hollow panel of claim 8, further comprising a first flange extending from a first edge of the base member and a recessed portion formed in the base member distal the first edge and adjacent a second edge of the base member.

10. The hollow panel of claim 9, said base member including a second flange extending from the base member and spaced above the first flange and a spring tab extending from the second edge of the base member.

11. The hollow panel of claim 7, wherein the first angle is about 45°.

12. The hollow panel of claim 7, wherein the first angled shoulder cooperates with a second angled shoulder of an adjacent hollow panel to form a peripheral grove, wherein the peripheral groove is visually similar to the groove formed in the face member.

13. The hollow panel of claim 7, wherein the flat finished surface includes a wood design.

14. A paneling system comprising:

a first panel and a second panel;

the first panel having a base member and a locking assembly, the locking assembly of the first panel including a first flange extending from an edge of the base member and a second flange projecting from the edge of the base member and being spaced above the first flange;

the second panel having a base member and a locking assembly, the locking assembly of the second panel including a recessed portion formed in the base member adjacent an edge of the base member and a tab extending from the edge of the base member;

wherein the first and second flanges of the locking assembly of the first panel cooperate with the tab of a locking assembly of the second panel to attach the first and second panels.

15. The paneling system of claim 14, wherein the first flange of the locking assembly of the first panel includes at least one longitudinal slot formed therein.

16. The paneling system of claim 14, wherein the tab of the locking assembly of the second panel is a spring tab.

17. The paneling system of claim 14, wherein the locking assembly of the first panel further comprises a fastener cooperating with the first flange.

18. The paneling system of claim 14, wherein the first panel further includes a face member spaced above the base member of the first panel and is connected to the base member of the first panel by a support member.

19. The paneling system of claim 18, wherein the support member is attached to the face member adjacent a vertex formed therein.

20. The paneling system of claim 14, wherein the second panel further includes a face member spaced above the base member of the second panel and is connected to the base member of the second panel by a support member.

21. The paneling system of claim 20, wherein the support member is attached to the face member adjacent a vertex formed therein.

22. A panel having:

a base member and a locking assembly; the locking assembly comprising:

a first flange extending from a first edge of the base member, a second flange projecting from the first edge of the base member, the second flange being spaced above the first flange, a recessed portion formed in the base member adjacent a second edge of the base member, and a spring tab extending from the second edge of the base member.

23. The panel of claim 22, wherein the first flange of the locking assembly includes at least one longitudinal slot formed therein.

24. The panel of claim 22, wherein the locking assembly further comprises a fastener cooperating with the first flange.

25. The panel of claim 22, wherein the first and second flanges of the locking assembly cooperate with the spring tab of the locking assembly of an adjacent building panel to attach the building panel to the adjacent building panel.

26. The panel of claim 22, further including a face member spaced above the base member and connected to the base member by a support member.

27. The panel of claim 26, wherein the support member is attached to the face member adjacent a vertex formed therein.

28. The hollow panel of claim 7, wherein the hollow panel of formed of polyvinyl chloride.

* * * * *